US007900277B1

(12) United States Patent
O'Brien et al.

(10) Patent No.: US 7,900,277 B1
(45) Date of Patent: Mar. 8, 2011

(54) WEIGHTED SLIP

(75) Inventors: Kerry K. O'Brien, Shelburne, VT (US); Louise Gagnon, S. Burlington, VT (US)

(73) Assignee: Her Look Enterprises LLC, South Burlington, VT (US)

( * ) Notice: Subject to any disclaimer, the term of this patent is extended or adjusted under 35 U.S.C. 154(b) by 378 days.

(21) Appl. No.: 11/830,275

(22) Filed: Jul. 30, 2007

Related U.S. Application Data

(60) Provisional application No. 60/834,062, filed on Jul. 28, 2006.

(51) Int. Cl.

| | |
|---|---|
| ***A41D 27/00*** | (2006.01) |
| ***A41D 27/06*** | (2006.01) |
| ***A41D 1/22*** | (2006.01) |
| ***A41D 1/14*** | (2006.01) |
| ***A41C 1/14*** | (2006.01) |

(52) U.S. Cl. ..... 2/273; 2/255; 2/74; 2/211

(58) Field of Classification Search ..... 2/211, 217, 2/222, 272, 273, 232, 255, 256, 257, 73, 2/74; 450/106, 112

See application file for complete search history.

(56) References Cited

U.S. PATENT DOCUMENTS

| | | | | | |
|---|---|---|---|---|---|
| 614,189 | A | * | 11/1898 | Waitzfelder | 2/273 |
| 1,024,957 | A | * | 4/1912 | Wein | 2/273 |
| 1,365,731 | A | * | 1/1921 | Schloss | 2/273 |
| 1,388,802 | A | * | 8/1921 | Cooper | 2/273 |
| 2,019,545 | A | * | 11/1935 | Roth | 2/73 |
| 2,253,339 | A | | 8/1941 | Livermore | |
| 2,429,128 | A | | 10/1947 | Hartridge | |
| 2,460,882 | A | * | 2/1949 | Gourdon | 2/73 |
| 2,541,698 | A | | 2/1951 | Gulisano | |
| 2,574,861 | A | | 11/1951 | Cooley | |
| 2,582,699 | A | * | 1/1952 | Jelaso et al. | 446/28 |
| 2,597,710 | A | * | 5/1952 | Delman | 2/221 |
| 2,611,133 | A | | 9/1952 | Brown | |
| 2,726,399 | A | * | 12/1955 | Ehnore | 2/73 |
| 2,834,021 | A | * | 5/1958 | Landauer | 2/273 |
| 2,899,962 | A | | 8/1959 | Entringer et al. | |
| 2,903,706 | A | * | 9/1959 | Alberts et al. | 2/215 |
| 3,066,308 | A | | 12/1962 | Erteszek | |
| 3,093,138 | A | | 6/1963 | Herman | |
| 3,212,503 | A | | 10/1965 | Gorman | |
| 3,339,553 | A | * | 9/1967 | Ritter | 450/30 |
| 3,399,679 | A | | 9/1968 | Barg | |
| 4,032,989 | A | * | 7/1977 | Jay et al. | 2/73 |
| 4,942,625 | A | | 7/1990 | Mecadon | |
| 5,090,059 | A | * | 2/1992 | Kahl | 2/104 |
| 6,076,193 | A | * | 6/2000 | Hood | 2/227 |
| 6,205,593 | B1 | * | 3/2001 | Schaub, Jr. | 2/242 |
| 2007/0256206 | A1 | * | 11/2007 | Nilsen | 2/69 |

FOREIGN PATENT DOCUMENTS

DE 3407268 * 8/1985

* cited by examiner

*Primary Examiner* — Gary L Welch
*Assistant Examiner* — Amber R Anderson
(74) *Attorney, Agent, or Firm* — Downs Rachlin Martin PLLC

(57) ABSTRACT

A garment, such as a woman's slip, that includes a skirt portion weighted so as to induce tension into the garment when worn by a wearer standing erect. The skirt portion is weighted by securing one or more concentrated tensioning weights to the skirt portion proximate its bottom. The tension induced into the garment by the concentrated tensioning weight(s) inhibits the garment from riding-up on the wearer. The amount of weight provided by the concentrated tensioning weights and the location of the tensioning weights on the skirt can be carefully selected to minimize swinging, for example, while walking and climbing stairs.

14 Claims, 2 Drawing Sheets

WEIGHTED SLIP

RELATED APPLICATION DATA

This application claims the benefit of priority of U.S. Provisional Patent Application Ser. No. 60/834,062, filed Jul. 28, 2006, and titled "Weighted Slip," which is incorporated by reference herein in its entirety.

FIELD OF THE DISCLOSURE

The present disclosure generally relates to the field of garments. In particular, the present disclosure is directed to a weighted slip.

BACKGROUND

Women typically wear full- or half-slips under dresses, skirts and skirt/blouse combinations for a variety of reasons, such as comfort and to prevent silhouetting of their legs through a sheer dress or skirt in backlit conditions, among other things. Slips are typically made to be relatively thin, lightweight, but opaque, and generally form-fitting in the hip and torso regions so as to inhibit interfering with the fit and drape of the dress or skirt under which the slip is worn. Slips are usually made of one or more thin and smooth layers of material so as to provide a low coefficient of friction between the slip and dress or skirt, and between the slip and skin or undergarment, for example, hosiery (nylons, leggings, etc.) or panties, among others. Despite the use of smooth materials, slips frequently "ride up," or bunch up into generally horizontal folds (when the wearer is standing erect) under conditions such as walking and moving from a crouched or bent-over position to a standing position. The problem of riding up is often exacerbated when the wearer of the slip is also wearing hosiery and in low humidity environments that tend to cause static electricity to build up in the various layers of a woman's attire. This static electricity leads to the phenomenon widely known as "static cling."

SUMMARY OF THE DISCLOSURE

One aspect of the present invention is a garment comprising a front, a back, a left side and a right side relative to a wearer when the wearer is properly wearing the garment while standing erect; a skirt portion having an upper end and a lower end when properly worn by the wearer while standing erect; and a plurality of concentrated weights secured to the skirt portion proximate the lower end, the plurality of concentrated weights selected specifically to tension the skirt portion between the upper end and the lower end when the wearer is properly wearing the garment and standing erect.

Another aspect of the present invention is a slip having a weight, comprising a front, a back, a left side and a right side relative to a wearer when the wearer is properly wearing the garment while standing erect; an intentionally tensioned skirt portion having an upper end and a lower end when properly worn by the wearer while standing erect, the intentionally tensioned skirt portion designed for being worn under an outer garment and comprising a fabric selected for opaqueness and for low coefficient of friction; a plurality of non-ornamental concentrated weights secured to the skirt portion proximate the lower end only on the left and right sides, the plurality of non-ornamental concentrated weights selected specifically to tension the skirt portion between the upper end and the lower end when the wearer is properly wearing the garment and standing erect, the plurality of non-ornamental concentrated weights having a total weight that is in a range of about 2% to about 10% of the weight of the slip and comprising weight elements having a density of at least 5 g/cm$^3$ Still another aspect of the present invention is a method of making an intentionally tensioned garment, comprising selecting a fabric for the garment; selecting concentrated tensioning weights to be used to tension a portion of the garment to a predetermined amount; making a skirt portion using the fabric, the skirt portion having an upper end and a lower end when the skirt portion is properly worn by a wearer standing erect; and securing the concentrated tensioning weights to the skirt portion proximate the lower ends in a distributed manner so that the concentrated tensioning weights tension the skirt portion when properly worn by a wearer standing erect.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 1A:
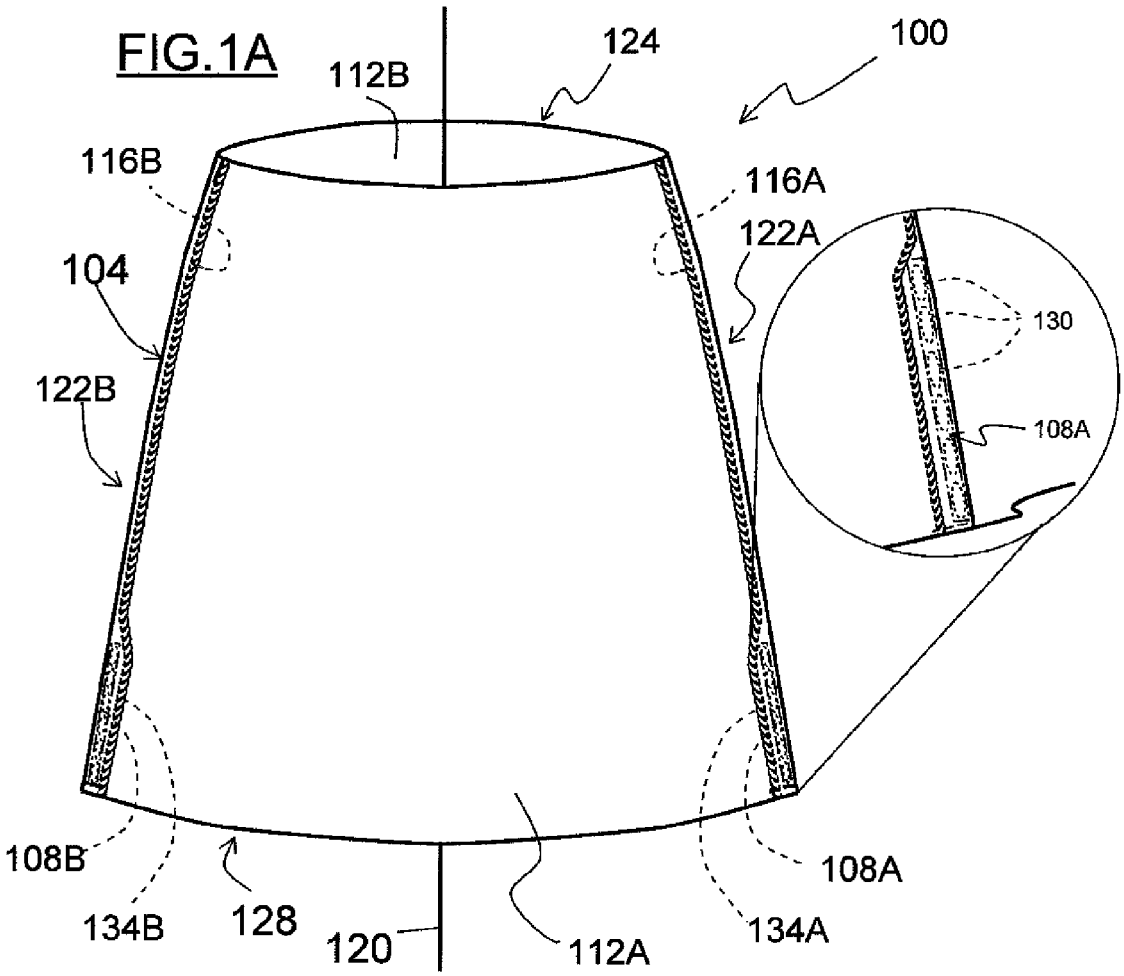
FIG. 1A contains a perspective view and an enlarged detail of a half-slip made in accordance with the present disclosure.
Figure 1B:
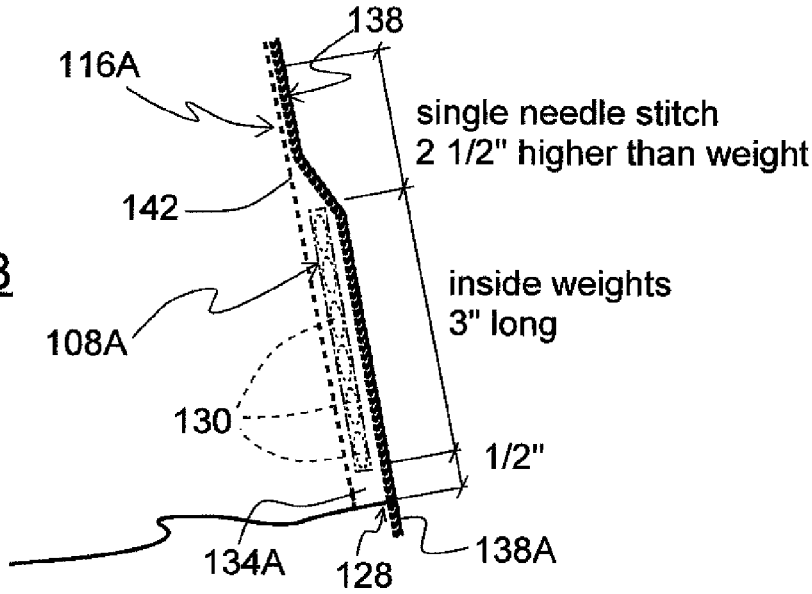
FIG. 1B is a partial schematic view/partial sewing diagram of the half-slip of FIG. 1A as taken at the bottom edge of the half-slip showing one of the weights located in a weight-concealing pocket integrated into one of the vertical seams of the half-slip.

Referring to the drawings, FIGS. 1A-B illustrate a weighted half-slip 100 made in accordance with the present disclosure. Generally, weighted half-slip 100 includes a skirt portion 104 and a plurality of tensioning weights, here weights 108A-B, secured to the skirt portion so as to reduce or eliminate the tendency of the slip to ride-up on a wearer during use. As discussed below in more detail, the plurality of weights may take any one of a variety of forms and may be secured to skirt portion 104 in any of a number of different manners and in any of a number locations.

Skirt portion 104 may be made of one or more panels 112A-B that substantially form the skirt portion. Unless skirt portion 104 is made from a continuous ring of fabric, it will include one or more seams where the ends of the panel(s), here panels 112A-B are joined to one another. In the example shown, skirt portion 104 is made from two panels that extend circumferentially and are joined together at their ends. More particularly, in this example, skirt portion 104 is substantially identical to the COMMANDO™ half slip currently available from Her Look Enterprises, South Burlington, Vt. Consequently, skirt portion 104 has two vertical seams 116A-B (vertical relative to the orientation of a wearer (not shown) when the wearer is properly wearing slip 100 and is standing erect) where the ends of the two panels 112A-B are joined to one another, in this example by sewing. Preferably, though not necessarily, at least some of the seams provided, such as seams 116A-B, are oriented substantially vertically relative to the longitudinal axis 120 of skirt portion 104 and are also preferably, but not necessarily, located on the sides 122A-B of the skirt portion, as shown and for reasons described below. Like the term "vertical" above, sides 122A-B (right and left, respectively) are determined relative to a wearer properly wearing the slip and standing erect. The same is true for the terms "front," "back," "upper end" and "lower end," as used below and in the appended claims.

It is noted that in the example shown in FIG. 1A neither the upper end 124 nor the lower end 128 of skirt portion 104 has a finished edge. While unfinished edges are not necessary and indeed are not practical with some types of fabric, keeping upper and lower ends of skirt portion 104 unfinished, among other things, generally increases the comfort of weighted half-slip 100 to the wearer and tends to make the slip visibly less noticeable to others. For example, the unfinished upper end 124 does not have an elastic waistband that could cause discomfort and lower end 128 is less pronounced than many finished and ornamented lower ends. Certain fabrics, such as a single layer of nylon-spandex blend microfiber fabric (which is used in the exemplary embodiment of FIGS. 1A-B), are known in the art to permit the use of unfinished edges. That said, in other embodiments, each or both of upper and lower ends 124, 128 may be finished, for example, by hemming, adding elastic, piping, tassel, lace, etc., as desired.

In the example shown in FIGS. 1A-B, each weight 108A-B is a cord-type weight that includes a plurality of individual weight elements 130, for example, metal cylinders or other structure made of, or otherwise containing, a dense material (relative to the bulk density of the fabric used for skirt portion 104), and that are inserted into a fabric sleeve. Such weights are commonly known as "sausage bead weighted tape" due to their appearance being reminiscent of sausage links that are strung together. Sausage bead weighted tape suitable for use as weights 108A-B is available commercially in several suitable sizes, such as 0.75 oz/yard (3/32" outside diameter, style A), 1 oz/yard (4/32" outside diameter, style B) and 1.4 oz/yard (5/32" outside diameter, style C). These particular styles utilize lead beads and a nylon-containing fabric sleeve. However, other styles may include beads and sleeves made of other materials. It is noted that lead has a density of 11.4 g/cm$^3$.

Of course, another type of weight may be used for each of weights 108A-B. For example, each weight may be a single weight element, for example, a rod or plate, etc., or be another type of multi-element weight, such as a chain (coated or uncoated and covered or uncovered), plastic tubing filled with relatively dense substance, for example, metal particles, sand, silicone, etc., among others. It is desirable for weight elements 130 to have a relatively high density, for example, greater than 5 g/cm$^3$ and preferably greater than 7 g/cm$^3$, so as to keep the size and obtrusiveness of weights 108A-B to a minimum. For the purposes of this disclosure and the appended claims, the term "concentrated" and like terms used to describe the tensioning weights means that the weights have a much higher density than the density fabric that makes up the bulk of the corresponding slip. Generally, for non-ornamental tensioning weights, the higher the density, the better, such as 7 g/cm$^3$ and above. However, for tensioning weights that are provided to also be ornamental, it is recognized that conventional ornamental material is typically not so dense, so that lower density weights may be used. Those skilled in the art will readily appreciate the variety of weights that may be used for either or both of weights 108A-B.

Each weight 108A-B is preferably, but not necessarily, secured to skirt portion 104 along a corresponding respective side (relative to the wearer and as distinguished from the front or back of the skirt portion relative to the wearer). In the example shown, seams 116A-B are located on the sides of skirt portion 104, and weights 108A-B are incorporated into the seams, for example, as described below in more detail. Locating each weight 108A-B along a corresponding seam 116A-B makes the weights generally less conspicuous. Placing weights 108A-B on the sides of skirt portion 104 may be especially beneficial when fewer, denser weights are provided in a concentrated manner because when the weights are on the sides of slip 100 they beneficially will swing less and/or not hit the legs of the wearer, for example, when walking or using stairs, as would be more likely to happen if the weights were located on the front and back of skirt portion 104 (again, "front" and "back" are taken relative to the wearer).

Figure 2:
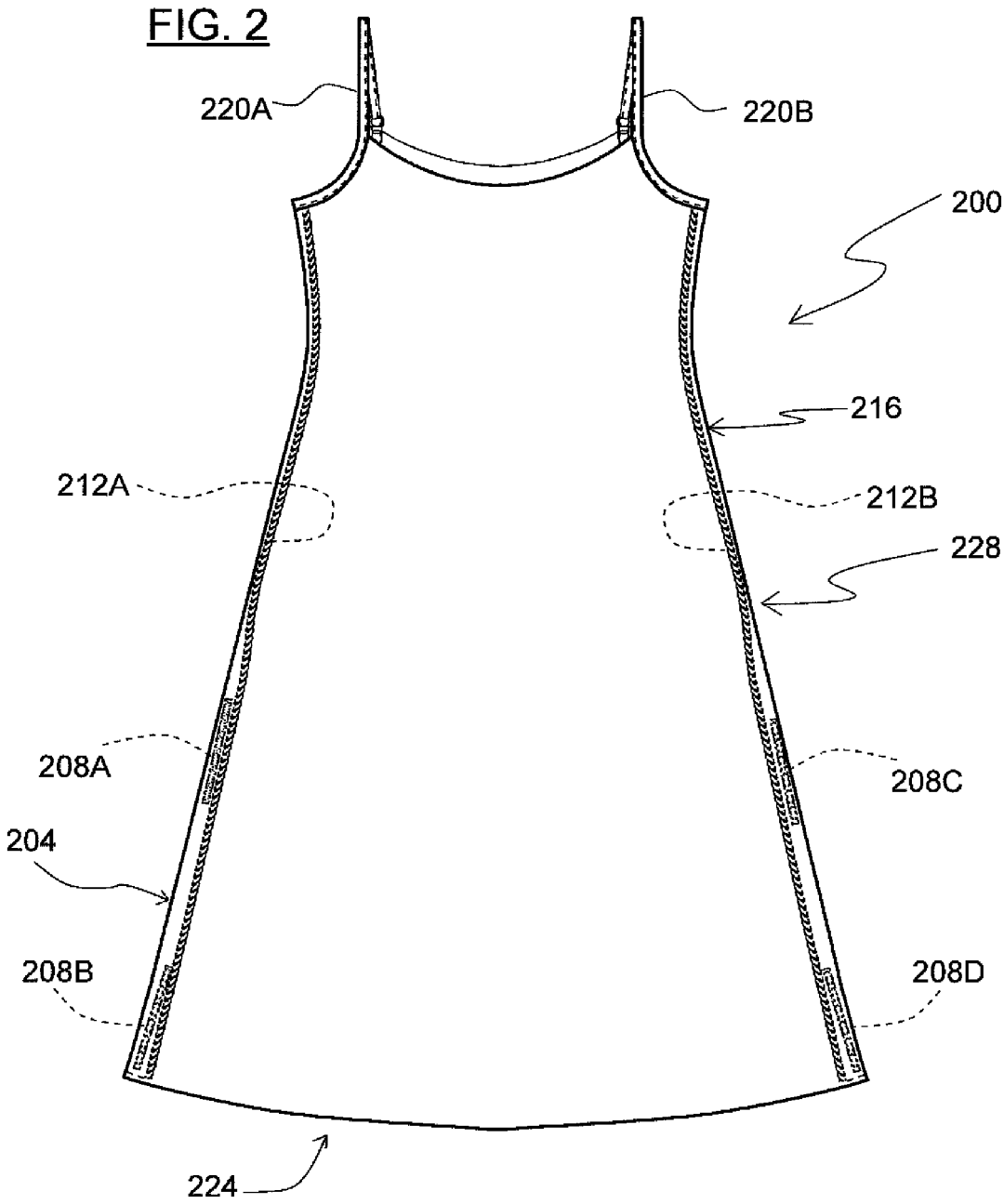
FIG. 2 is an elevational view of a full-slip made in accordance with the present disclosure.

That said, in alternative embodiments, it may be desirable to provide the predetermined amount of added weight more uniformly around the circumference of skirt portion 104. For example, non-ornamental or ornamental individual weights (not shown) may be secured to skirt portion 104 at a regular pitch, for example, 3 inches, or, alternatively, a relatively long single continuous weight, for example, one of the multi-element weights mentioned above, may be secured to the skirt portion around its entire periphery. It is noted that while weights 108A-B are shown as being fastened to skirt portion 104 near its lower end 128, each weight may be located higher up on the skirt portion, if desired. In addition, while only a single weight 108A-B is shown on each seam 116A-B, alternative embodiments may include two or more weights per seam, as illustrated in FIG. 2.

Still referring to FIGS. 1 A-B, each weight 108A-B may be secured to skirt portion 104 in any manner suitable for the type of weight used. In the present embodiment, wherein each weight 108A-B is a fabric-sleeved tape, the weights are sewn into skirt portion 104 by creating virtually hidden pockets 134A-B in conjunction with the overlock side-seam stitching 138 in the manner shown in FIG. 1B. To create pockets 134A-B (only pocket 134A is shown in FIG. 1B), each panel 112A-B is provided with a little extra fabric (e.g., about 0.25 inch) at the location of each pocket for use in forming the pockets. For example, if a 3" long 4/32" diameter piece of weighted tape is used for weights 108A-B, the additional amount of material at each pocket 134A-B may be on the order of 3.5 inches long and 0.25 inches wide. Overlock stitching 138 is run along the outside edges of the two panels 112A-B and an additional single-needle stitching 142 is used to form and close each pocket 134A-B. Single-needle stitching 142 is extended beyond the upper end of the corresponding pockets 134A-B by a suitable distance, for example about 2.5 inches (about 6.4 cm), to join with overlock stitching 138 so that seams 116A-B appear straight when slip 100 (FIG. 1A) is folded outside-out after sewing.

The sewing instructions for installing weights 108A-B into skirt portion 104 for the example shown are as follows. Place panels 112A-B outside-face to outside-face in registration with one another and sew overlock stitching 138 on the two side-ends of the panels, leaving about 0.5 inch of an overlock tail 138A. Place each weight 108A-B along the corresponding respective seam 116A-B starting 0.5 inch from hem and sew single-needle stitching 142 straight along that weight from lower end 128 of skirt portion 104 to about 2 inches to about 2.5 inches above the upper end of that weight. Fold back each overlock tail 138A inside the respective seam 116A-B and provide a horizontal backtack (not shown), for example, about 0.25 inch to about 0.38 inch long, on the front of each side adjacent lower end 128 to secure the corresponding weight 108A-B in the respective pocket 134A-B and to tack the overlock tail.

In alternative embodiments, other sewing or needling techniques, or other fastening techniques, for example, bonding, riveting, etc., may be used. In addition, it is noted that weights 108A-B may be inserted into pockets or other structures (not shown) provided to skirt portion 104. Also, once each weight

108A-B is secured to skirt portion 104, if desired it may be covered with a functional and/or ornamental fabric or other panel or structure. It is also noted that while weights 108A-B are shown as being present on the inside of skirt portion 104, in other embodiments each weight may be provided on the outer side of the skirt portion. Again, it is presently contemplated that in some embodiments it may be desired to provide weighted half-slip 100 with ornamentation, for example, lacing, tassels, additional fabric strips/panels, etc. Consequently, weights 108A-B or other weights provided may be incorporated into such ornamentation.

Generally, the amount of weight that weights 108A-B add to the non-weight components of weighted half-slip 100 may be determined by balancing a number of factors, including: 1) providing enough weight to acceptably inhibit the riding-up phenomenon; 2) not providing so much weight that the desired drape/hang of skirt portion 104 is unacceptably impacted; and 3) not providing so much weight that the weights swing excessively during walking or other movement of the wearer. In many, but not all cases, the amount of weight added by weights 108A-B is based on tensioning a portion of skirt portion 104 below the waistline of the wearer. However, in other embodiments, for example, full-slip 200 of FIG. 2, it may be desirable to tension the portion of the garment above the waistline as well. That said, even in full-slip 200, it may be desirable to tension only the portion below the waistline, especially if the slip is relatively form fitting. Generally speaking, a presently preferred amount of weight added by the concentrated weights is about 2% to about 10% of the garment without the weights. More preferably, the amount of weight added is about 3% to about 8% of the un-weighted garment. More specifically, for half-slip 100, the preferred weight of weights 108A-B is between about 7% and 10%. The following Table lists some examples of weight percentages used in various slips currently available from Her Look Enterprises, mentioned above. The slips in each of these examples are made from a single layer of a nylon-spandex blend fabric and have unfinished upper and lower ends.

TABLE

| | | SIZE | |
|---|---|---|---|
| STYLE | COLOR | S/M | M/L |
| Half-slip (finished) | black | 2.7 oz. | 3.0 oz. |
| Half-slip (w/o weights) | black | 2.5 oz. | 2.8 oz. |
| Weight alone | | 0.2 oz. (3 in. of style B tape) | 0.23 oz. (3.5 in. of style B tape) |
| % weight of unweighted slip | | 8% | 8% |
| Full-slip (finished) | black | 4.1 oz. | 4.7 oz. |
| Full-slip (w/o weights) | black | 3.9 oz. | 4.4 oz. |
| Weight alone | | 0.2 oz. (3 in. of style B tape) | 0.23 oz. (3.5 in. of style B tape) |
| % weight of unweighted slip | | 5% | 5% |
| Mini-cami slip (finished) | black | 3.2 oz. | 3.6 oz. |
| Mini cami slip (w/o weights) | black | 3.1 oz. | 3.4 oz. |
| Weight alone | | 0.12 oz. (2 in. of style B tape) | 0.16 oz. (2.5 in. of style B tape) |
| % weight of unweighted slip | | 4.2% | 4.7% |
| Mini-tank slip (finished) | black | 3.2 oz. | 3.6 oz. |
| Mini-tank slip (w/o weights) | black | 3.1 oz. | 3.4 oz. |
| Weight alone | | 0.13 oz. (2 in. of style B tape) | 0.16 oz. (2.5 in. of style B tape) |
| % weight of unweighted slip | | 4.2% | 4.7% |

Those skilled in the art will appreciate that the foregoing ranges and exemplary percentages may need to be varied depending upon, for example, the particular material, style, fit and construction of the garment at issue. In addition, the particular percentage used with the range will generally vary with the type of slip, for example, half-slip, full-slip and maxi-slip. This is so because in the cases of full- and maxi-slips, the total weight of the unweighted garment often includes fabric and other components, such as shoulder straps, shoulder-strap hardware, etc., that do not affect the drape of the garment for which the tensioning is being provided. In any event, the amount of weight added via the additional weights, here weights 108A-B, is selected to provide a predetermined amount of tension to slip 100.

By "predetermined" it is meant herein and in the appended claims that the weight was selected based on consideration of countering the riding-up phenomenon by inducing tension into the garment (e.g., slip 100). Thus, "predetermined weight" does not include weight that is added without consideration of this purpose, such as weight that is added by providing piping, tassel, lace, etc. solely for another purpose, such as finishing edges and ornamentation. In this connection, it is noted that weights 108A-B are non-ornamental weights, i.e., they are not provided to the slip to provide any sort of ornamentation. On the contrary, weights 108A-B are provided solely for the functional reason of tensioning slip 100. However, in other embodiments, it is envisioned that high-density weights could be made to be attractive and could actually serve a dual purpose of being both functional and ornamental.

FIG. 2 illustrates a weighted full-slip 200 made in accordance with the present disclosure. Similar to weighted half-slip of FIGS. 1A-B, weighted full-slip 200 of FIG. 2 includes a skirt portion 204 and a plurality of tensioning weights 208A-D secured to the skirt portion. Also similar to weighted half-slip 100 of FIGS. 1A-B, weights 208A-D may be secured to weighted full-slip 200 at the corresponding respective side seams 212A-B of skirt portion 204. Those skilled in the art will appreciate that all of the discussion of placement, selection, attachment, configuration, etc. of weights 108A-B of FIGS. 1A-B applies equally to weights 208A-D of FIG. 2 so that it is not necessary to repeat that discussion.

That said, several points are noted for clarity. In addition to skirt portion 204, full-slip 200 of FIG. 2 also includes a torso portion 216 that is connected to the skirt portion and extends generally above the hip/waist region of a wearer (not shown). In this example, full-slip 200 is fairly form fitting, but not necessarily so tight that skirt portion 204 is supported by the wearer separately from torso portion 216, which is largely supported by a pair of shoulder straps 220A-B. Consequently, in this example skirt portion 204 is in not-insignificant measure also supported by shoulder straps 220A-B. When it is desired to tension both torso portion 216 and skirt portion 204, it can be beneficial to split the weights between at least two vertical levels of full-slip 200 (relative to a wearer standing erect) as shown in FIG. 2 so that the tension is induced into the slip in stages from the bottom up. When the weights, here weights 208A-D, are split in this manner, a situation in which all of the weight of the weights is concentrated at the bottom end 224 of skirt portion 204 is avoided. This minimizes the amount of unwanted swinging of the weights at bottom end 224 of skirt portion 204 where the effect would be most pronounced, since the amount of added tensioning weight at the bottom end of the skirt portion is reduced. It is noted that an upper level of weights, here weights 208A, 208C, are generally located proximate upper end 228 of skirt portion 204. In this example, since skirt portion 204 is not self-supporting via a tight fit with the wearer, weights 208A, 208C are located proximate upper end 228 of the skirt portion, and the balance of the tensioning weight, i.e., weights 208B, 208D, is located proximate lower end 224 of the skirt portion. Of course, full-slip 200 may be single or multi-panel in a manner similar to half-slip 100 of FIG. 1A and, therefore, may have similar alternative embodiments.

It is noted that depending on the type of weights used, the tightness of the fit of a particular slip and the style of slip at issue it may not be desirable to have an upper level of weights, or at least a level of weights at a location where the weights would interfere with the comfort of the wearer. For example, if full-slip 200 were form-fitting, the upper level of weights 208A, 208C may not be desirable because they would be felt by the wearer. Multiple levels of concentrated weights could readily be used in a maxi-length slip (not shown), which has a long drape-length.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A garment, comprising:

a front, a back, a left side and a right side relative to a wearer when the wearer is properly wearing the garment while standing erect;

a skirt portion having an upper end and a lower end when properly worn by the wearer while standing erect, wherein said skirt portion includes a first seam located on said left side and a second seam located on said right side, and each of said first and second seams having a longitudinal axis that is vertical when said skirt portion is properly worn by the wearer while standing erect; and a plurality of concentrated weights secured to said skirt portion along said first and second seams proximate said lower end, said plurality of concentrated weights selected specifically to tension said skirt portion between said upper end and said lower end when the wearer is properly wearing the garment and standing erect;

wherein each of said plurality of concentrated weights has a longitudinal length and is incorporated into one or the other of said first and second seams along substantially the entirety of said longitudinal length.

2. The garment of claim 1, wherein each of said plurality of concentrated weights is located in a weight-concealing pocket formed integrally with a corresponding one of said first and second seams.

3. The garment of claim 2, wherein each of said concentrated weights comprises a sausage bead weighted tape.

4. The garment of claim 1, wherein said skirt portion is a slip-skirt portion made of a fabric selected for opaqueness and for low coefficient of friction.

5. The garment of claim 1, wherein each of said upper and lower ends are unfinished and said skirt portion is supported on a wearer by snugness of fit with hips of the wearer.

6. The garment of claim 1, wherein the garment has a weight and the total weight of said plurality of concentrated weights is selected to be in a range of about 2% to about 10% of the weight of the garment.

7. The garment of claim 6, wherein the total weight of said plurality of concentrated weights is selected to be in a range of about 3% to about 8% of the weight of the garment.

8. The garment of claim 1, wherein each of said plurality of concentrated weights includes at least one weight element having a density of at least 5 g/cm$^3$.

9. The garment of claim 8, wherein said density is at least 7 g/cm$^3$.

10. The garment of claim 1, further comprising a torso portion connected to said skirt portion at said upper end of said skirt portion and having a third seam located on said left side and a fourth seam located on said right side, each of said third and fourth seams having a longitudinal axis that is vertical when said skirt portion is properly worn by the wearer, said left side of the garment including a first upper weight extending along said third seam proximate said upper end of said skirt portion and a first lower weight extending along said first seam proximate said lower end of said skirt portion, and said right side of the garment similarly including a second upper weight extending along said fourth seam proximate said upper end of said skirt portion and a second lower weight along said second seam proximate said lower end of said skirt portion.

11. A slip having a weight, comprising:

a front, a back, a left side and a right side relative to a wearer when the wearer is properly wearing the garment while standing erect;

an intentionally tensioned skirt portion having an upper end and a lower end when properly worn by the wearer while standing erect, said intentionally tensioned skirt portion designed for being worn under an outer garment and comprising a fabric selected for opaqueness and for low coefficient of friction, wherein said intentionally tensioned skirt portion includes a first seam located on said left side and a second seam located on said right side, and each of said first and second seams having a longitudinal axis that is vertical when said skirt portion is properly worn by the wearer while standing erect;

a plurality of non-ornamental concentrated weights secured to said skirt portion along said first and second seams proximate said lower end only on said left and right sides, said plurality of non-ornamental concentrated weights selected specifically to tension said skirt portion between said upper end and said lower end when the wearer is properly wearing the garment and standing erect, said plurality of non-ornamental concentrated weights having a total weight that is in a range of about 2% to about 10% of the weight of the slip and comprising weight elements having a density of at least 5 g/cm$^3$;

wherein each of said plurality of non-ornamental concentrated weights has a longitudinal length and is incorporated into one or the other of said first and second seams along substantially the entirety of said longitudinal length.

12. The slip of claim 11, wherein each of said upper and lower ends are unfinished and said intentionally tensioned skirt portion is supported on a wearer by snugness of fit with hips of the wearer.

13. The slip of claim 11, further comprising a torso portion connected to said intentionally tensioned skirt portion at said upper end of said intentionally tensioned skirt portion and having a third seam located on said left side and a fourth seam located on said right side, each of said third and fourth seams having a longitudinal axis that is vertical when said skirt portion is properly worn by the wearer, said left side of the garment including a first upper non-ornamental weight extending along said third seam proximate said upper end of said intentionally tensioned skirt portion and a first lower non-ornamental weight extending along said first seam proximate said lower end of said intentionally tensioned skirt portion, and said right side of the garment similarly including a second upper non-ornamental weight extending along said fourth seam proximate said upper end of said intentionally tensioned skirt portion and a second lower non-ornamental weight extending along said second seam proximate said lower end of said intentionally tensioned skirt portion.

14. The slip of claim 11, further comprising a first weight-concealing pocket formed integrally with said first side seam and a second weight-concealing pocket formed integrally with said second side seam, wherein said plurality of weights includes a first sausage bead weighted tape segment and a second sausage bead weighted tape segment and said first sausage bead weighted tape is located in said first weight-concealing pocket and said second sausage bead weighted tape is located in said second weight-concealing pocket.

* * * * *